US008032961B1

(12) United States Patent
Downs

(10) Patent No.: US 8,032,961 B1
(45) Date of Patent: Oct. 11, 2011

(54) SHEET HARNESS APPARATUS

(76) Inventor: Lorraine McEachin Downs, Coral Springs, FL (US)

( * ) Notice: Subject to any disclaimer, the term of this patent is extended or adjusted under 35 U.S.C. 154(b) by 0 days.

(21) Appl. No.: 12/291,480

(22) Filed: Nov. 10, 2008

(51) Int. Cl.

| | |
|---|---|
| ***A47C 20/02*** | (2006.01) |
| ***A47C 16/00*** | (2006.01) |
| ***B68G 5/00*** | (2006.01) |
| *A47G 9/02* | (2006.01) |
| *A47C 21/02* | (2006.01) |

(52) U.S. Cl. ..... 5/655; 5/494; 5/498; 5/923

(58) Field of Classification Search ..... 5/655, 494, 5/496, 498, 922, 923, 482, 411; 128/872, 128/873, 875, 876

See application file for complete search history.

(56) References Cited

U.S. PATENT DOCUMENTS

| | | | | |
|---|---|---|---|---|
| 2,342,069 | A * | 2/1944 | Wilkinson | 128/872 |
| 4,802,244 | A | 2/1989 | McGrath-Saleh | |
| 5,233,714 | A | 8/1993 | DeBell | |
| 5,280,657 | A * | 1/1994 | Stagg | 5/81.1 R |
| 5,746,219 | A | 5/1998 | McConnell | |
| 5,843,065 | A * | 12/1998 | Wyant | 604/385.09 |
| 6,381,785 | B1 * | 5/2002 | Mancera Browne et al. | 5/655 |
| 6,499,165 | B1 * | 12/2002 | Morgillo | 5/655 |
| 6,641,568 | B2 * | 11/2003 | Ashton et al. | 604/385.01 |
| 6,708,356 | B1 | 3/2004 | LaValle | |
| 6,834,405 | B1 * | 12/2004 | Hillstead | 5/655 |
| 6,837,880 | B2 * | 1/2005 | Trimble | 604/393 |
| 2005/0028278 | A1 * | 2/2005 | Landry | 5/494 |
| 2008/0029103 | A1 * | 2/2008 | Regev et al. | 128/875 |

* cited by examiner

*Primary Examiner* — Jonathan Liu
(74) *Attorney, Agent, or Firm* — Oltman Flynn & Kubler

(57) ABSTRACT

A sheet harness apparatus for retaining and supporting a person on top of a bed on their back, where the bed includes a head of the bed and a foot of the bed, a mattress, means for elevating the head of the bed relative to the foot of the bed and thereby positioning the mattress at an incline, and bed parts including a bed spring and a bed frame, the sheet harness apparatus including a sheet having a sheet head end and a sheet foot end and a sheet upper surface and a sheet lower surface, for fitting onto a mattress; a harness fastened to the sheet; and at least one sheet anchor strap with a strap connected end fastened to the sheet and a strap anchoring end having a strap anchoring fastener, for wrapping around a part of a bed at the head of the bed and fastening to itself, so that the strap anchoring end forms a loop around a part of the bed and thereby prevents the sheet from sliding toward the foot of the bed.

20 Claims, 6 Drawing Sheets

SHEET HARNESS APPARATUS

BACKGROUND OF THE INVENTION

1. Field of the Invention

The present invention relates generally to the fields of medical and hospital equipment. More specifically the present invention relates to a sheet harness apparatus for retaining and supporting a person on top of a bed on their back, and preferably at the center of the bed, whether the mattress is positioned horizontally or on an incline, for safely orienting and positioning a person such as an infant having SIDS (Sudden Infant Death Syndrome), GURDS, or a cold, who cannot lie on his or her stomach. The apparatus can support and secure adults as well, such as invalids and hospitalized patients lying on a mattress raised to an inclined angle to help them eat and swallow food.

The apparatus includes a waist harness such as a diaper or a pair of shorts fastened to a fitted sheet having a sheet head end and a sheet foot end for fitting onto a mattress, and at least one sheet anchor strap with a strap connected end fastened to the sheet head end and with a strap anchoring end having a strap anchoring fastener for wrapping around a part of a bed at the head of the bed such as the bed springs or bed frame and fastening to itself, so that the strap anchoring end forms a loop around a part of the bed and thereby prevents the fitted sheet from sliding toward the foot of the bed, such as when the mattress head end or head of the bed is raised to place the mattress at an incline. The waist harness preferably is fastened to the center of the fitted sheet upper surface and preferably with sewn stitches. The strap anchoring fastener alternatively fastens to part of the bed itself, or to any other object at or adjacent to the head of the bed. Two spaced apart and parallel sheet anchor straps preferably are provided and both fastened to the sheet head end for wrapping around a part or parts of the bed so that support at the sheet head end is more broadly distributed. The sheet anchor strap or straps preferably are fastened with sewn stitches to the sheet lower surface, near the center of the fitted sheet. Each strap anchoring fastener preferably includes mating hook and loop fastener patches which are positioned to meet and engage when the anchoring strap is looped around part of a bed.

The waist harness preferably takes the form of a diaper which, for an adult includes diaper fasteners in the form of sets of tie ports, each tie port being fitted with a grommet, and tie strips for fitting through registering tie ports. For a child, lighter and easier to operate fasteners such as snap fasteners are substituted for the tie ports and tie strips. A fly preferably is provided in the adult diaper, so that the fly provides access to the groin and a catheter can be passed through the fly.

2. Description of the Prior Art

There have long been devices and assemblies for securing a person reclined on a support surface such as a mattress or reflux wedge. Elkin, et al., U.S. Pat. No. 7,251,846, issued on Aug. 7, 2007, discloses a harness for securing an infant to a reflux wedge, including a crotch support and straps extending over the top of the reflux wedge and secured to back of the reflux wedge.

LaValle, U.S. Pat. No. 6,708,356, issued on Mar. 23, 2004, teaches a bedding article including a top panel secured to a bottom panel with fasteners to define openings for receiving the legs and lower torso of a baby. Fasteners extend radially from the periphery of the bottom panel to releasibly secure the bottom panel to a sleeping surface.

Hillstead, U.S. Pat. No. 6,834,405, issued on Dec. 28, 2004, reveals a mechanism for securing an infant in the supine position, including a supporting pad having an infant retaining harness at its center and laterally extending straps wrapping around the sides of a mattress.

McConnell, U.S. Pat. No. 5,746,219, issued on May 5, 1998, discloses an infant sleep positioning device including a child harness and laterally extending straps for engaging upright side posts of a crib.

De Bell Daniel, U.S. Pat. No. 5,233,714, issued on Aug. 10, 1993, teaches an infant restraining device including an infant supporting structure with portions which wrap around the sides of a mattress.

McGrath-Saleh, U.S. Pat. No. 4,802,244, issued on Feb. 7, 1989, discloses a premature infant bedding construction including a bedding to receive a prone body of an infant and a U-shaped retainer.

It is thus an object of the present invention to provide a sheet harness apparatus which comfortably and yet securely secures a person within a harness at the center of a mattress when the mattress is positioned at an incline, the harness being secured with straps extending over the head of the mattress to an anchoring structure such as the frame of a bed.

It is another object of the present invention to provide such a sheet harness apparatus in which the harness is secured to the center of a fitted sheet so that the harness remains centered on the mattress.

It is still another object of the present invention to provide such a sheet harness apparatus which optionally includes a fly to pass a catheter from a patient.

It is finally an object of the present invention to provide such a sheet harness apparatus which is easy to use, can be laundered, and is relatively inexpensive to manufacture.

SUMMARY OF THE INVENTION

The present invention accomplishes the above-stated objectives, as well as others, as may be determined by a fair reading and interpretation of the entire specification.

A sheet harness apparatus for retaining and supporting a person on top of a bed on their back, where the bed includes a head of the bed and a foot of the bed, a mattress, means for elevating the head of the bed relative to the foot of the bed and thereby positioning the mattress at an incline, and bed parts including a bed spring and a bed frame, the sheet harness apparatus including a sheet having a sheet head end and a sheet foot end and a sheet upper surface and a sheet lower surface, for fitting onto a mattress; a harness fastened to the sheet; and at least one sheet anchor strap with a strap connected end fastened to the sheet and a strap anchoring end having a strap anchoring fastener, for wrapping around a part of a bed at the head of the bed and fastening to itself, so that the strap anchoring end forms a loop around a part of the bed and thereby prevents the sheet from sliding toward the foot of the bed when the head of the bed is elevated to position the mattress at an incline.

The sheet preferably is a fitted sheet. The harness preferably is a waist harness. The waist harness optionally is a diaper. The waist harness preferably is fastened to the center of the sheet upper surface. The waist harness preferably is fastened to the sheet with sewn stitches. The sheet harness preferably includes two spaced apart and parallel such sheet anchor straps both fastened to the sheet for wrapping around a part of a bed, so that support is broadly distributed across the sheet. The sheet anchor strap preferably is fastened to the sheet lower surface. The strap anchoring fastener optionally including a hook and loop fastener patch.

The waist harness preferably includes a diaper having a diaper front panel, a diaper rear panel, a connecting segment interconnecting the front and rear panels and diaper fasteners for connecting the diaper front panel to the diaper rear panel. The diaper fasteners preferably include one of tie ports and tie strips, and snap fastener halves. Each tie port preferably is fitted with a grommet. The sheet harness preferably additionally includes a fly for providing access to the groin of a wearer and a catheter can be passed through the fly. The fly preferably has overlapping fly edges and registering tie ports secured together with a tie strip.

A bed and sheet harness apparatus is further provided, including a bed including a head of the bed and a foot of the bed, a mattress, and bed parts including a bed frame, including a fitted sheet having a sheet head end and a sheet foot end and a sheet upper surface and a sheet lower surface, for fitting onto a mattress; a harness fastened to the fitted sheet; and at least one sheet anchor strap with a strap connected end fastened to the sheet and a strap anchoring end for securing the strap connected end at and relative to the head of the bed; so that the strap anchoring end prevents the fitted sheet from sliding toward the foot of the bed when the head of the bed is raised to position the mattress at an incline.

The harness preferably is a waist harness. The strap anchoring end preferably includes a strap anchoring fastener for causing the strap anchoring end to removably fasten to itself after forming a loop around a part of the bed. The sheet preferably is a fitted sheet.

A bed and sheet harness apparatus is provided, including a bed having a head of the bed and a foot of the bed, a mattress, a mechanism for elevating the head of the bed to position the mattress at an incline and bed parts including a bed spring, the bed and sheet harness apparatus including a fitted sheet having a sheet head end and a sheet foot end and a sheet upper surface and a sheet lower surface, for fitting onto a mattress; a waist harness fastened to the fitted sheet; and at least one sheet anchor strap with a strap connected end fastened to the sheet and a strap anchoring end for securing the strap connected end at and relative to the head of the bed; so that the strap anchoring end prevents the fitted sheet from sliding toward the foot of the bed when the head of the bed is raised to position the mattress at an incline.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
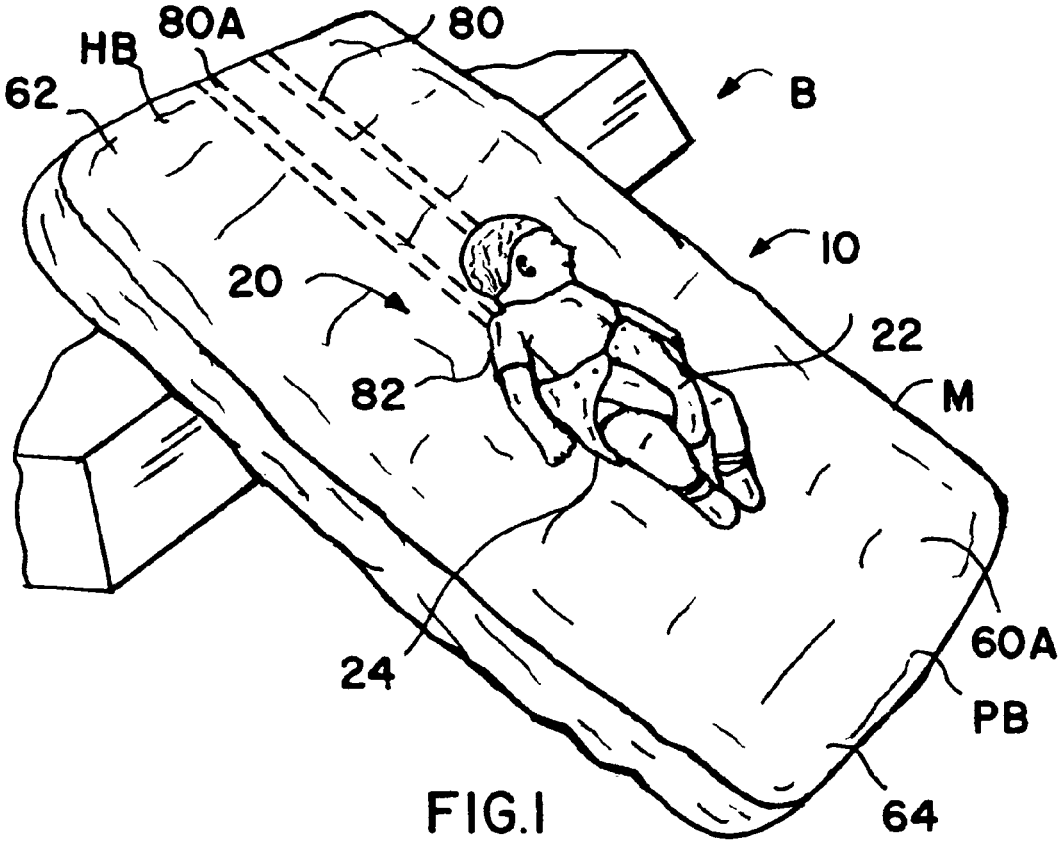
FIG. 1 is a perspective view of the child version of the present invention retaining a child and fitted onto a mattress resting at an incline.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
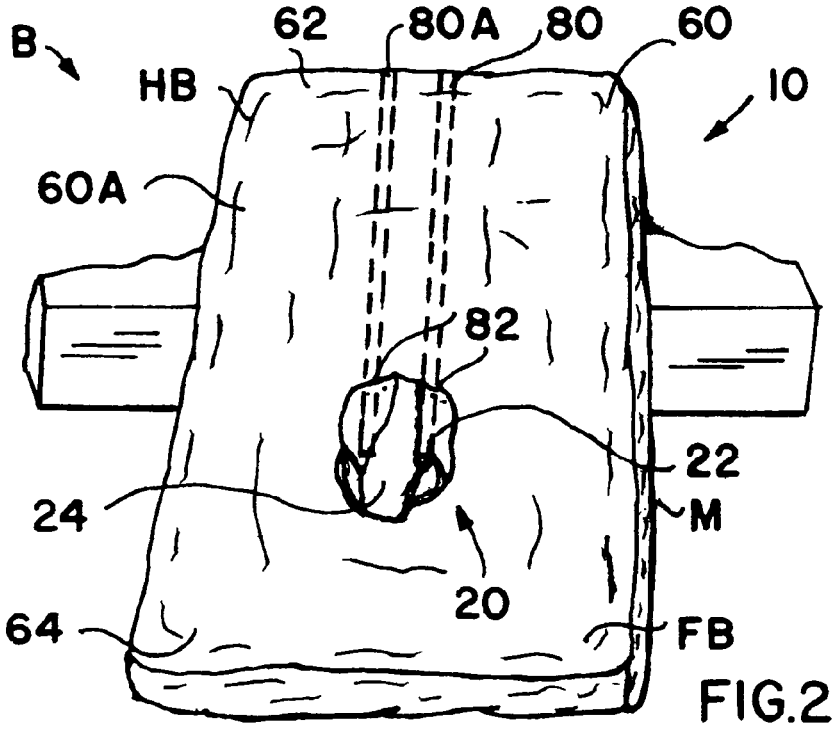
FIG. 2 is a front view of the apparatus and mattress as in FIG. 1, with the child omitted.
Figure 3:
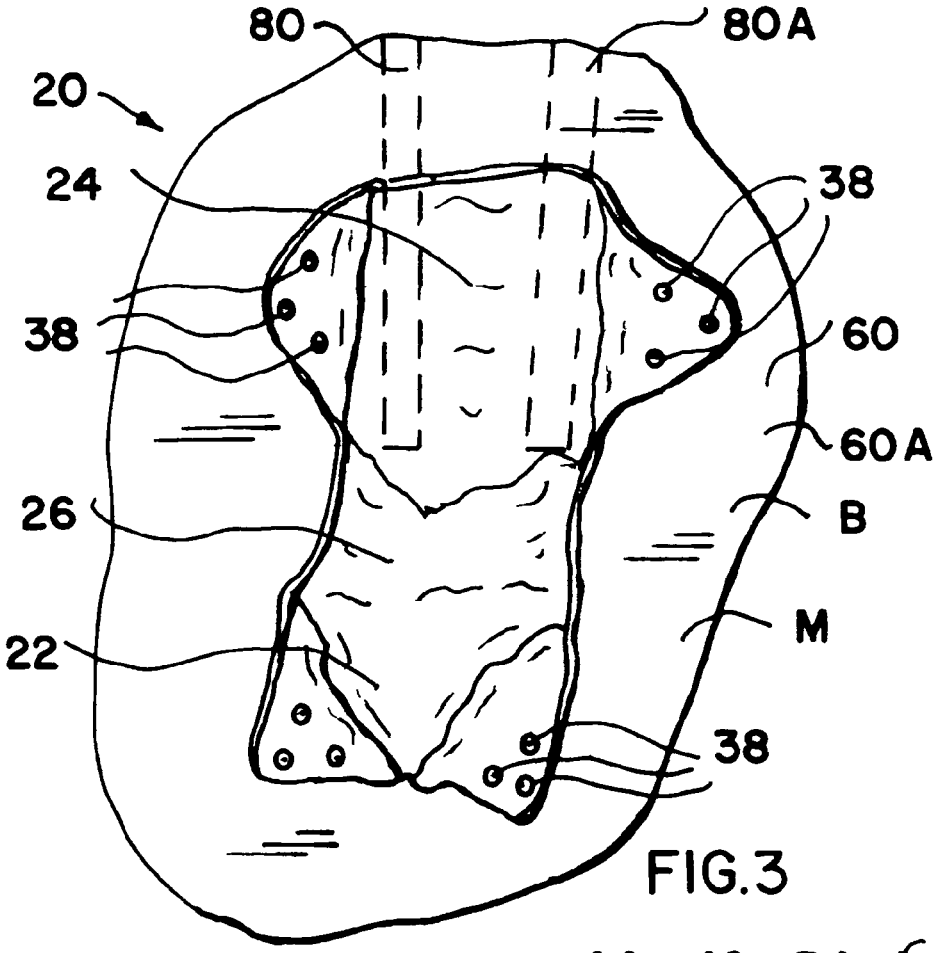
FIG. 3 is a broken away top view of part of the fitted mattress and the harness in the form of a child diaper having snap fasteners and opened to receive a person.
Figure 4:
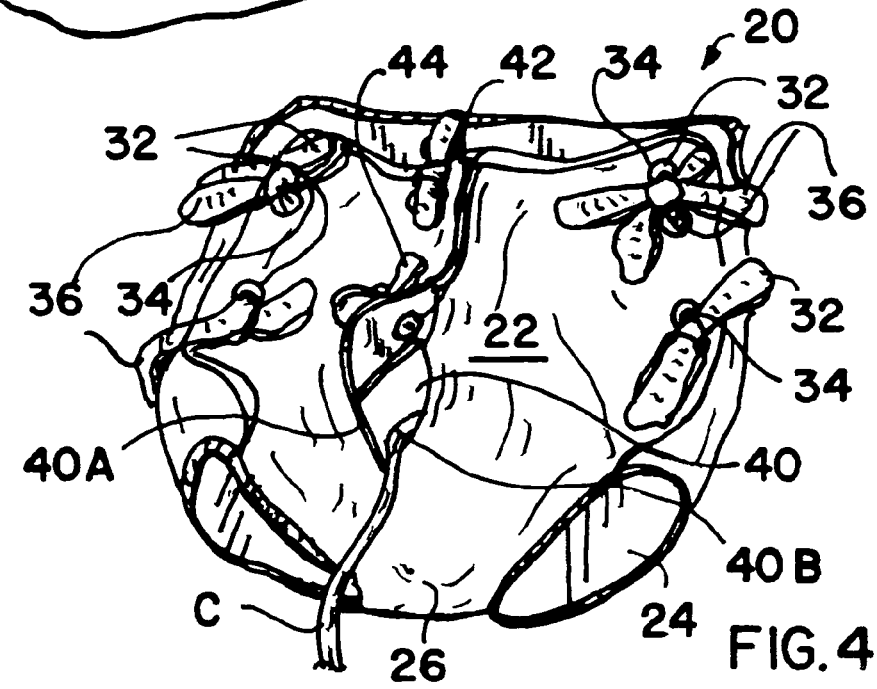
FIG. 4 is a view of the adult diaper fastened closed with tie strips passing through tie ports, and showing the fly and a catheter segment passing through the fly.
Figure 5:
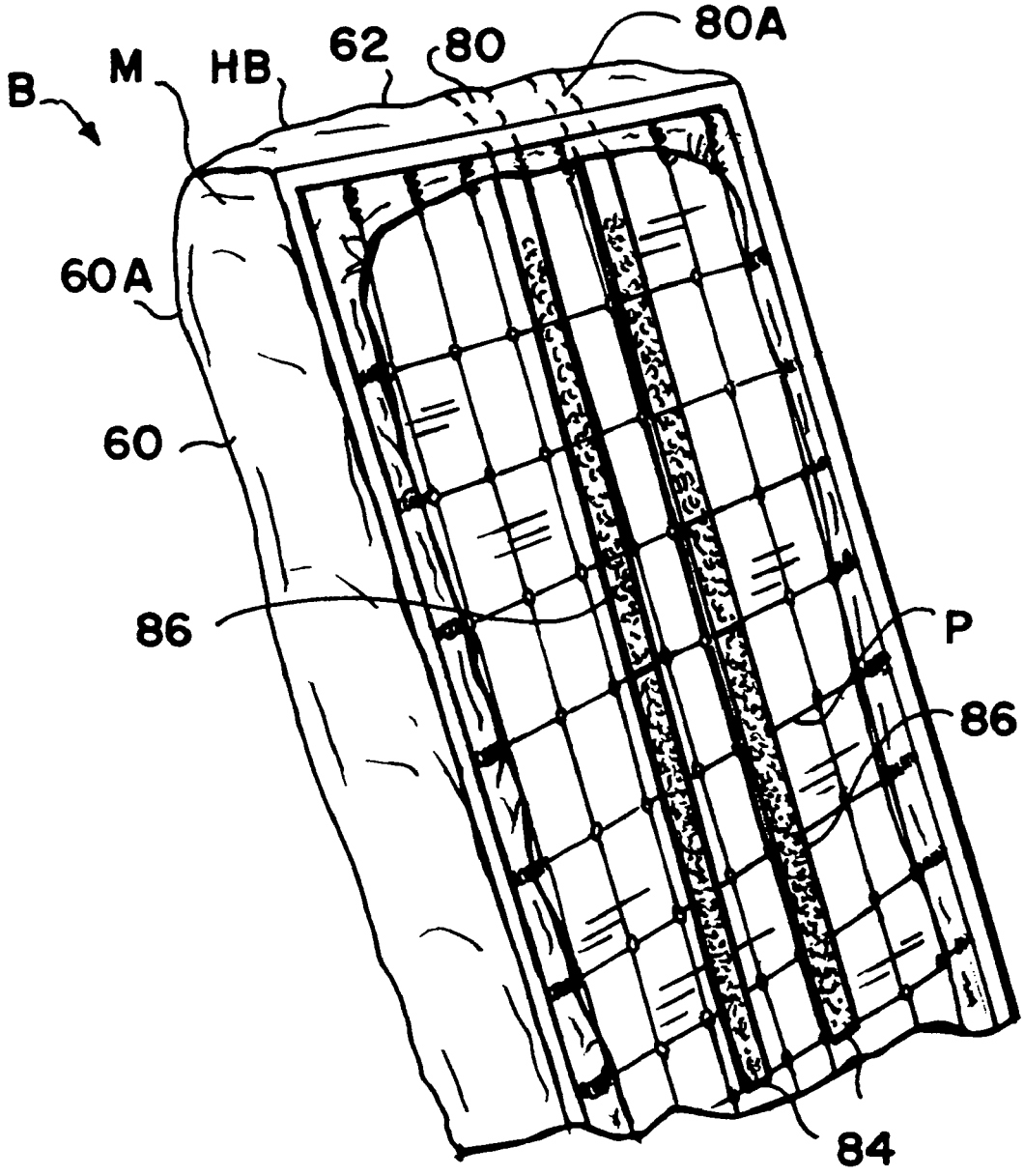
FIG. 5 is a partial view of the bottom of a bed showing the head of the bed and the fitted sheet of the present invention and the anchoring straps extended underneath and along the bottom of the bed, the straps being fitted under the spring assembly and ready to be doubled back and fastened with hook and loop fasteners.
Figure 6:
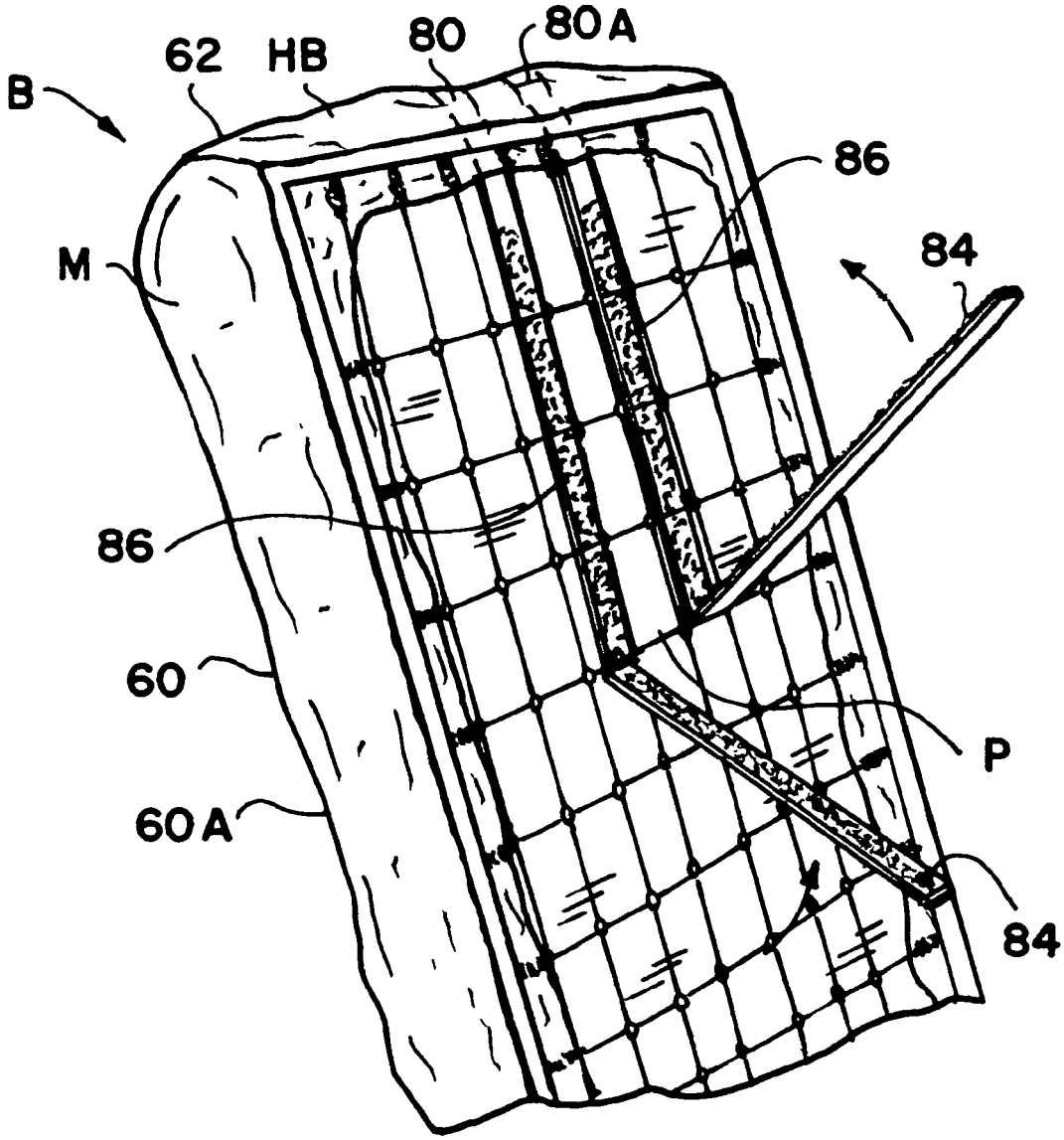
FIG. 6 is a view as in FIG. 5, showing the anchoring straps partly pivoted around part of the bed springs toward a fastened position.
Figure 7:
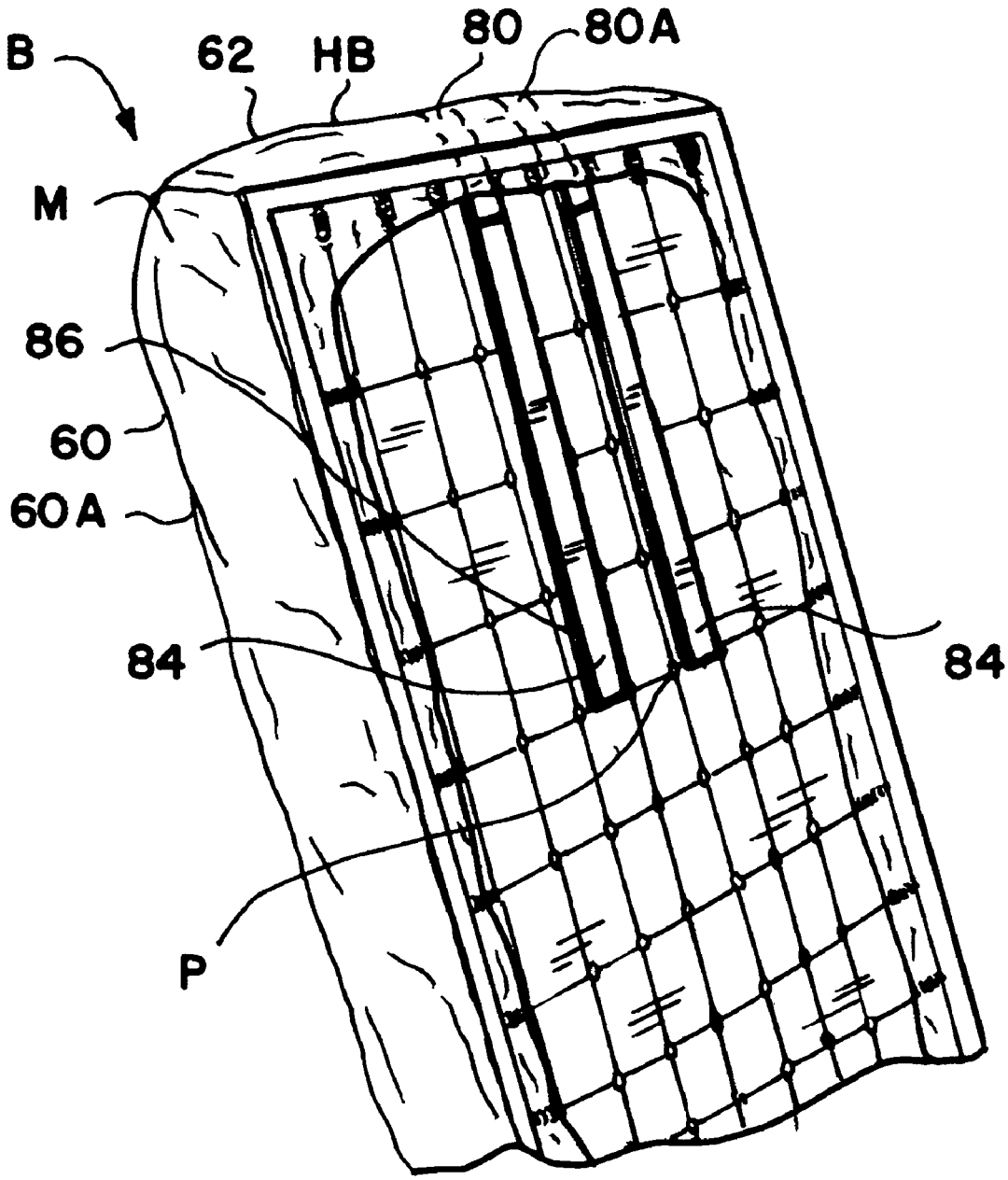
FIG. 7 is a view as in FIGS. 5 and 6, showing the anchoring straps fully pivoted and doubled back so that the hook and loop strap fasteners engage to hold the straps in place to anchor the harness on top of the bed.
Figure 8:
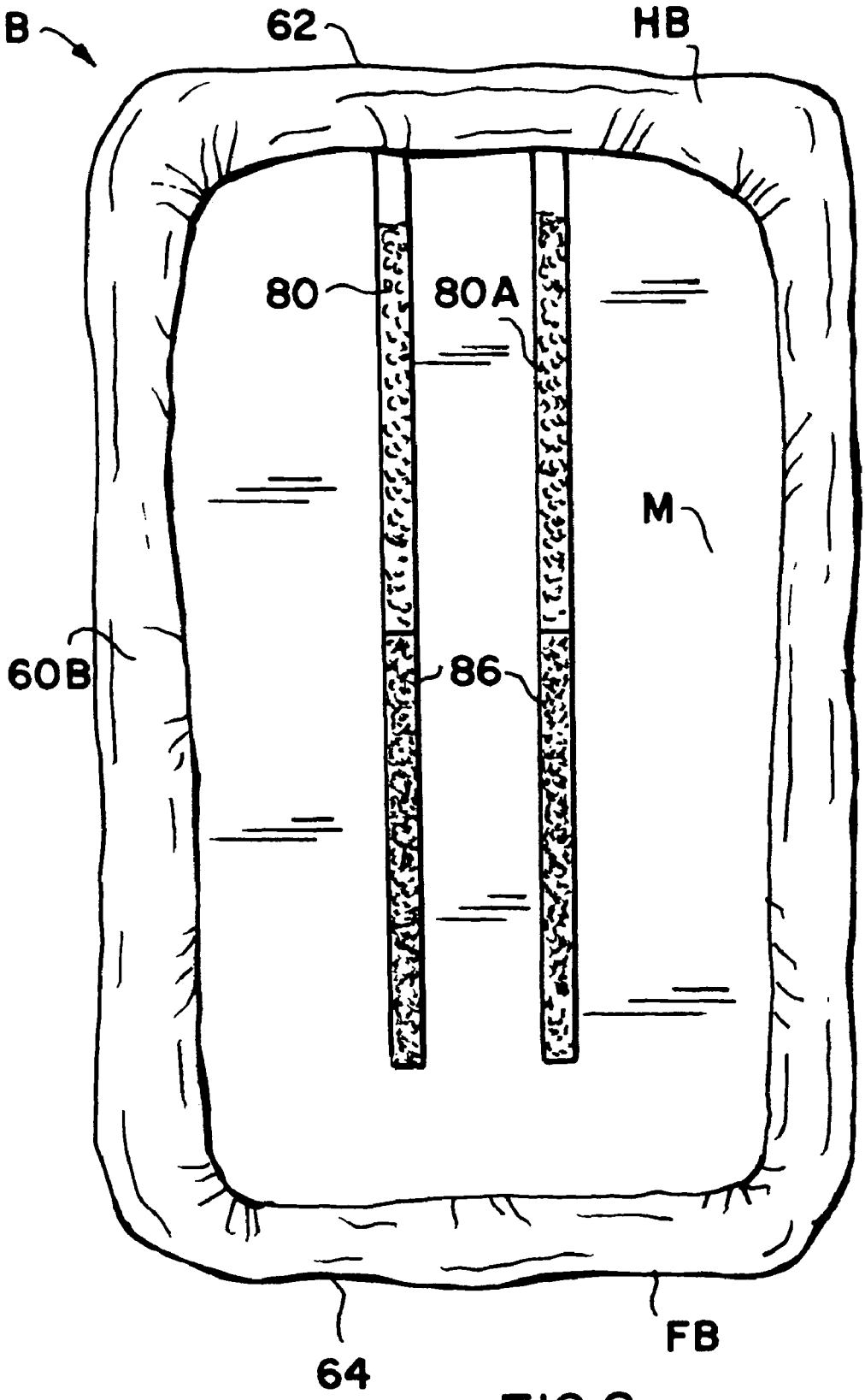
FIG. 8 is a plan view of the bottom of a mattress fitted with the fitted sheet and showing the anchoring straps extended underneath and along the bottom of the bed.

Referring to FIGS. 1-8, a sheet harness apparatus 10 is disclosed for retaining and supporting a person on top of a bed B on their back, and preferably at the center of the bed B, whether the mattress M is positioned horizontally or on an incline.

Apparatus 10 includes a waist harness 20 such as a diaper or a pair of shorts fastened to a sheet 60 which preferably is a fitted sheet and having a sheet head end 62 and a sheet foot end 64 for fitting onto a mattress M, and at least one sheet anchor strap 80 with a strap connected end 82 fastened to the sheet head end 62 and with a strap anchoring end 84 having a strap anchoring fastener 86 for wrapping around a part P of a bed B at the head HB of the bed B such as the bed springs or bed frame and fastening to itself, so that the strap anchoring end 84 forms a loop around a part P of the bed B and thereby prevents the fitted sheet 60 from sliding toward the foot FB of the bed B such as when the head HB of the bed B is raised to place the mattress M at an incline.

The waist harness 20 preferably is fastened to the center of the fitted sheet upper surface 60A and preferably with sewn stitches. Two spaced apart and parallel sheet anchor straps 80 and 80A preferably are provided and both fastened to the sheet head end 62 for wrapping around a part or parts P of the bed B so that support at the sheet head end 62 is more broadly distributed. The sheet anchor strap or straps 80 and 80A preferably are fastened with sewn stitches to the sheet lower surface 60B, near the center of fitted sheet 60. Each strap anchoring fastener 86 preferably includes mating hook and loop fastener patches which are positioned to meet and engage when the anchoring strap is looped around part of a bed B. See FIG. 8.

The waist harness 20 preferably takes the form of a diaper having a diaper front panel 22, a diaper rear panel 24, a connecting segment 26 interconnecting front and rear panels 22 and 24 and diaper fasteners 38. The rear panel 24 is positioned behind the wearer, the interconnecting segment 26 is passed between the wearer legs in the manner of a conventional diaper, the front panel 22 is placed over the wearer abdomen, and the front panel 22 is fastened to the rear panel 24 with diaper fasteners 38. For an adult, the diaper fasteners 38 includes sets of tie ports 32 on the diaper front panel 22 and on the diaper rear panel 24 which register when the diaper 20 is fitted onto the wearer, and tie strips 36 are fitted through the registering tie ports 32 and tied to fasten the diaper around the wearer. Each tie port 32 preferably is fitted with a grommet 34. For a child, lighter and easier to operate fasteners such as mating snap fastener halves 38 are substituted for the tie ports 32 and tie strips 36. See FIG. 3. A fly 40 is provided in the adult diaper 20 having overlapping fly edges 40A and 40B and registering tie ports 42 secured together with a tie strip 44, so that the fly 40 provides access to the groin and a catheter C can be passed through the fly 40.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A bed and sheet harness apparatus, comprising:

a bed comprising a head of the bed and a foot of the bed, a mattress, means for elevating the head of the bed to position the mattress at an incline and bed parts including bed springs and a bed frame;

a fitted sheet engagingly wrapping around the sides of and gripping said mattress to restrain the sheet against substantially movement relative to said mattress, said fitted sheet having a sheet center and a sheet head end and a sheet foot end and a sheet upper surface and a sheet lower surface;

a waist harness fastened to said fitted sheet at one of: the center of said fitted sheet and near the center of said fitted sheet;

and at least two spaced apart and substantially parallel anchor straps each with a strap connected end and being fastened to said sheet lower surface directly underneath said waist harness and extending to said sheet head end adjacent to the head of said bed, and a strap anchoring end wrapped around a portion of one of the bed springs and the bed frame;

such that said anchor straps maintain the position of said waist harness on said mattress when said head of said bed is raised to position the mattress at an incline, wherein said strap anchoring ends each comprise a strap anchoring fastener for causing said strap anchoring ends to each removably fasten to itself after forming a loop around a part of the bed.

2. The bed and sheet harness apparatus of claim 1, wherein said waist harness is a diaper.

3. The bed and sheet harness apparatus of claim 1, wherein said waist harness is fastened to the center of said sheet upper surface.

4. The bed and sheet harness apparatus of claim 1, wherein said waist harness is fastened to said sheet with sewn stitches.

5. The bed and sheet harness apparatus of claim 1, wherein said strap anchoring fasteners each comprise a hook and loop fastener patch.

6. The bed and sheet harness apparatus of claim 1, wherein said waist harness comprises a diaper having a diaper front panel, a diaper rear panel, a connecting segment interconnecting said front and rear panels and diaper fasteners for connecting said diaper front panel to said diaper rear panel.

7. The bed and sheet harness apparatus of claim 6, wherein said diaper fasteners comprise one of tie ports and tie strips, and snap fastener halves.

8. The bed and sheet harness apparatus of claim 7, wherein each said tie port is fitted with a grommet.

9. The bed and sheet harness apparatus of claim 7, additionally comprising a fly for providing access to the groin of a wearer and a catheter can be passed through said fly.

10. The bed and sheet harness apparatus of claim 9, wherein said fly has overlapping fly edges and registering tie ports secured together with a tie strip.

11. A bed and sheet harness apparatus, comprising:

a bed comprising a head of the bed and a foot of the bed, a mattress, means for elevating the head of the bed to position the mattress at an incline and bed parts including bed springs and a bed frame;

a fitted sheet engagingly wrapping around the sides of and gripping said mattress to restrain the sheet against substantially movement relative to said mattress, said fitted sheet having a sheet center and a sheet head end and a sheet foot end and a sheet upper surface and a sheet lower surface;

a waist harness fastened to said fitted sheet at one of: the center of said fitted sheet and near the center of said fitted sheet;

and at least one anchor strap having a strap connected end and being fastened to said sheet lower surface directly underneath said waist harness and extending to said sheet head end adjacent to the head of said bed, and a strap anchoring end wrapped around a portion of one of the bed springs and the bed frame;

such that said at least one anchor strap maintains the position of said waist harness on said mattress when said head of said bed is raised to position the mattress at an incline, wherein said strap anchoring end comprises a strap anchoring fastener for causing said strap anchoring end to removably fasten to itself after forming a loop around a part of the bed.

12. The bed and sheet harness apparatus of claim 11, wherein said waist harness is a diaper.

13. The bed and sheet harness apparatus of claim 11, wherein said waist harness is fastened to the center of said sheet upper surface.

14. The bed and sheet harness apparatus of claim 11, wherein said waist harness is fastened to said sheet with sewn stitches.

15. The bed and sheet harness apparatus of claim 11, wherein said strap anchoring fastener comprises a hook and loop fastener patch.

16. The bed and sheet harness apparatus of claim 11, wherein said waist harness comprises a diaper having a diaper front panel, a diaper rear panel, a connecting segment interconnecting said front and rear panels and diaper fasteners for connecting said diaper front panel to said diaper rear panel.

17. The bed and sheet harness apparatus of claim 16, wherein said diaper fasteners comprise one of tie ports and tie strips, and snap fastener halves.

18. The bed and sheet harness apparatus of claim 17, wherein each said tie port is fitted with a grommet.

19. The bed and sheet harness apparatus of claim 18, additionally comprising a fly for providing access to the groin of a wearer and a catheter can be passed through said fly.

20. The bed and sheet harness apparatus of claim 19, wherein said fly has overlapping fly edges and registering tie ports secured together with a tie strip.

* * * * *